US008317243B2

(12) United States Patent
Emond et al.

(10) Patent No.: US 8,317,243 B2
(45) Date of Patent: Nov. 27, 2012

(54) GRIPPING DEVICE FOR LOAD STRUCTURE

(75) Inventors: Laval Emond, Chicoutimi (CA); Gilbert Fortin, Jonquiere (CA)

(73) Assignee: ECB Novatech Inc., Chicoutimi, Quebec (CA)

( * ) Notice: Subject to any disclaimer, the term of this patent is extended or adjusted under 35 U.S.C. 154(b) by 320 days.

(21) Appl. No.: 12/449,502

(22) PCT Filed: Feb. 12, 2008

(86) PCT No.: PCT/CA2008/000276

§ 371 (c)(1), (2), (4) Date: Feb. 12, 2010

(87) PCT Pub. No.: WO2008/098356

PCT Pub. Date: Aug. 21, 2008

(65) Prior Publication Data

US 2010/0148528 A1 Jun. 17, 2010

Related U.S. Application Data

(60) Provisional application No. 60/890,359, filed on Feb. 16, 2007.

(51) Int. Cl.
*B66C 1/42* (2006.01)

(52) U.S. Cl. ..... 294/67.33; 294/90; 294/103.1

(58) Field of Classification Search ..... 294/63.1, 294/67.33, 81.54, 81.62, 82.12, 82.13, 90, 294/103.1, 119.1

See application file for complete search history.

(56) References Cited

U.S. PATENT DOCUMENTS

| | | | | | |
|---|---|---|---|---|---|
| 1,272,359 | A | * | 7/1918 | Bell | 294/103.1 |
| 2,327,005 | A | | 8/1943 | Babcock et al. | 294/110 |
| 2,471,323 | A | | 5/1949 | Harrington | 294/93 |
| 2,573,216 | A | | 10/1951 | Natoli | 294/74 |
| 2,789,858 | A | | 8/1953 | Kughler | 294/81 |
| 3,261,637 | A | | 7/1966 | Bopp et al. | |
| 3,352,591 | A | | 11/1967 | Casey | 294/81 |
| 3,488,079 | A | | 1/1970 | Stinchfield | 294/78 |
| 3,939,368 | A | | 2/1976 | Albaric et al. | 310/59 |
| 4,055,327 | A | | 10/1977 | Burgi | 254/47 |
| 4,135,655 | A | | 1/1979 | Brown | 224/45 |
| 4,213,647 | A | | 7/1980 | Thurmond, Jr. | 294/90 |
| 4,225,118 | A | | 9/1980 | Ottemann | 254/333 |
| 4,243,354 | A | | 1/1981 | Garcia | 414/607 |
| 4,272,220 | A | | 6/1981 | Garcia | 414/607 |
| 4,336,962 | A | * | 6/1982 | Read | 294/106 |
| 4,619,475 | A | | 10/1986 | Sylvest, II | 294/90 |
| 4,630,855 | A | | 12/1986 | Bjurling | 294/81.21 |
| 4,893,861 | A | | 1/1990 | Stoltzman | 294/119.2 |
| 5,171,053 | A | | 12/1992 | Rouleau | 294/106 |
| 5,303,968 | A | | 4/1994 | Trine | 294/106 |

(Continued)

*Primary Examiner* — Dean Kramer
(74) *Attorney, Agent, or Firm* — Harrington & Smith

(57) ABSTRACT

A device for gripping a load structure includes a first jaw member having a proximate end and a distal end, a second jaw member slidably mounted to the first jaw member and having a proximate end and a distal end. Each of the two jaw members is provided with a gripper. The device further includes a fulcrum member mounted to the first jaw member near the proximate end thereof and a flexible element secured to the second jaw member near the distal end thereof operatively coupled to the fulcrum member for causing an externally applied pulling force on the flexible element to move the distal end of the first jaw member towards the distal end of the second jaw member so as to yield a first inward force between the first and second grippers.

12 Claims, 6 Drawing Sheets

U.S. PATENT DOCUMENTS

| | | | | | |
|---|---|---|---|---|---|
| 5,344,207 | A | * | 9/1994 | Grimm | 294/103.1 |
| 5,441,322 | A | | 8/1995 | Jobmann et al. | 294/90 |
| 5,460,469 | A | | 10/1995 | Young | 414/11 |
| 5,489,032 | A | | 2/1996 | Mayhall, Jr. et al. | 212/285 |
| 5,829,948 | A | | 11/1998 | Becklund | 414/607 |
| 6,601,892 | B2 | | 8/2003 | Scarborough | 294/103.1 |
| 6,749,392 | B1 | | 6/2004 | Adams et al. | 414/800 |
| 6,789,827 | B2 | | 9/2004 | Webster et al. | 294/81.5 |
| 7,000,965 | B2 | | 2/2006 | Lorincz | 294/67.33 |
| 7,278,671 | B1 | | 10/2007 | Herford | 294/110.1 |

* cited by examiner

GRIPPING DEVICE FOR LOAD STRUCTURE

CROSS-REFERENCE TO A RELATED PATENT APPLICATION

This is a U.S. National Stage Patent Application based on International Application Number PCT/CA2008/000276 which was filed Feb. 12, 2008, which claims priority to U.S. Provisional Application No. 60/890,359 which was filed on Feb. 16, 2007.

FIELD

The present invention concerns gripping devices and methods. More specifically, the present invention concerns a gripping device and method that can be used in lifting heaving objects such as barrels.

BACKGROUND

Many devices are known in the art to grasp a load structure such as a barrel while it is lifted. Such devices usually include first and second members operatively coupled so as to define a movable claw which is designed to grasp the load. They further include an anchoring member or portion to secure the device to a lift.

A first drawback of known devices for grasping load structure is that they tend to have their anchoring member relatively distanced from the load when attached thereto. This may yield some instability when the load is lifted.

Another drawback of most of such devices from the prior art is that they are tedious to install on the load, requiring in some cases two workers to perform the task.

Also, devices for grasping load structure from the prior art are usually adapted to a load having a predetermined dimension and weight and, as such, are not polyvalent.

DETAILED DESCRIPTION

Figure 1:
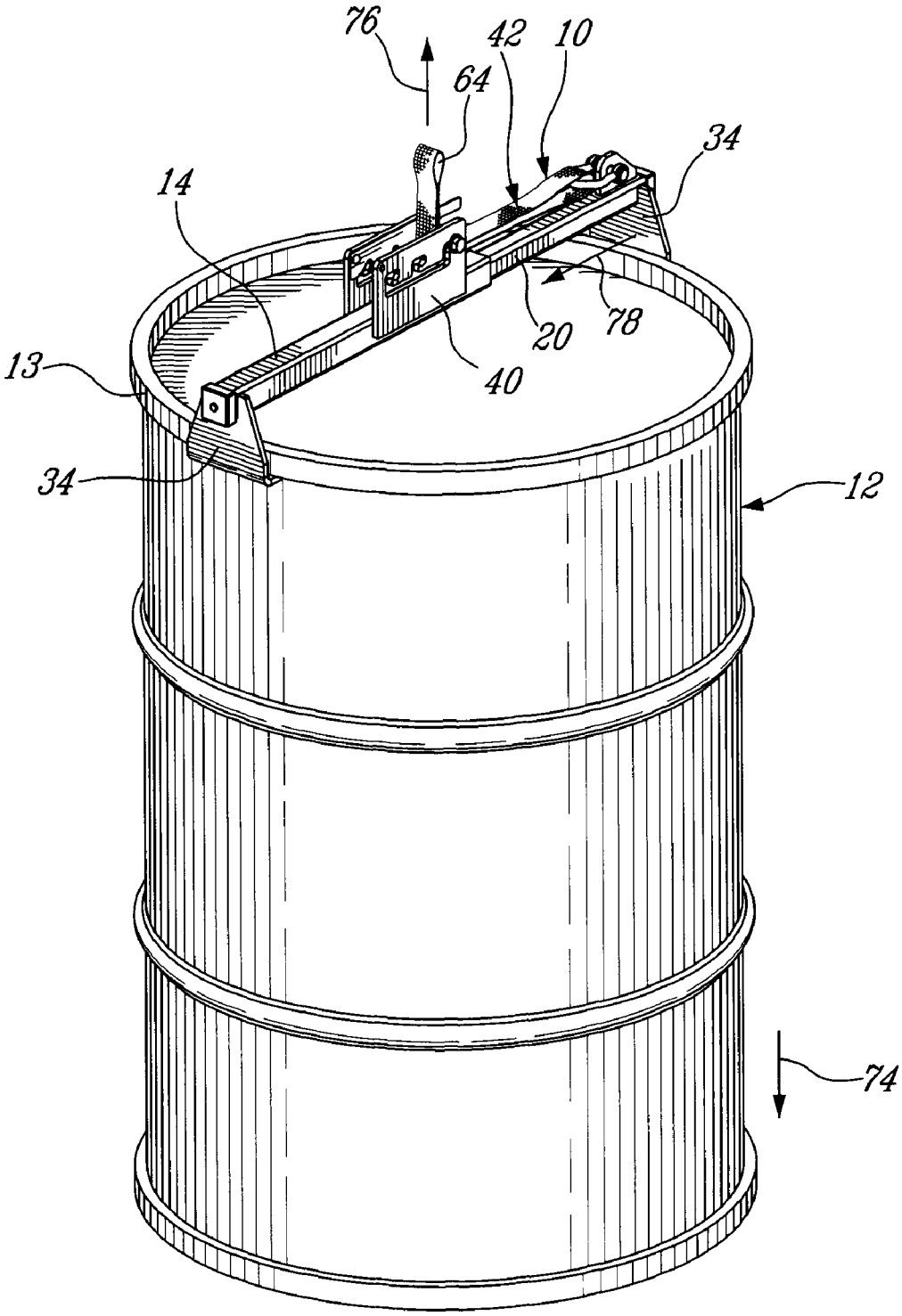
FIG. 1 is a perspective view of a device for gripping a load structure according to first illustrative embodiment of the present invention; the device being shown mounted to a barrel.

More specifically, in accordance with the present invention, there is provided a device for gripping a load structure comprising:

a first jaw member having a proximate end and a distal end; the distal end of the first jaw member being provided with a first gripper;

a second jaw member having a proximate end and a distal end; the distal end of the second jaw member being provided with a second gripper; the second jaw member being slidably mounted to the first jaw member so as to define a jaw therewith having an variable distance between the first and second grippers;

a fulcrum member mounted to the first jaw member near the proximate end thereof; and a flexible element secured to the second jaw member near the distal end thereof operatively coupled to the fulcrum member for causing an externally applied pulling force on the flexible element to move the distal end of the first jaw member towards the distal end of the second jaw member so as to yield a first inward force between the first and second grippers.

According to a more specific aspect of the present invention, the device further comprises a biasing member mounted to both the first and second members for pulling the distal end of the first jaw member and the distal end of the second jaw member towards one another, causing a permanent second inward force between the first and second grippers.

This second inward force causes the device to automatically close on the load to grip. Therefore, the device can be operated by a single user (not shown) when it is used, for example, in cooperation with a crane or any other lifting apparatus (not shown), whereby the device automatically holds firmly onto the load while the user attaches the device to a hook or any fastener (not shown) from the crane.

The first and second jaw members are advantageously tubes or generally flat members so that the center of gravity of the device remains adjacent to the load so as not to unbalance it.

The device for gripping a load structure according to the present invention is particularly suitable to be used for lifting a load, such as a barrel, since the weight of the load can be used as the externally applied force when the device is hung by its flexible element.

Other objects, advantages and features of the present invention will become more apparent upon reading the following non restrictive description of illustrated embodiments thereof, given by way of example only with reference to the accompanying drawings.

In the following description, similar features in the drawings have been given similar reference numerals, and in order not to weigh down the figures, some elements are not referred to in some figures if they were already identified in a precedent figure.

A device 10 for gripping a load structure 12 according to an illustrated embodiment of the present invention will now be described with reference to FIGS. 1 to 5.

As can be seen in FIG. 1 and as will be described hereinbelow in more detail, the device 10 can be used to grip a barrel 12 during its lifting. The barrel 12 is provided with a generally circular top rim 13.

However, as will also be described furtherin, the device for gripping a load structure according to the present invention can be modified to lift other load. Also, it can be used and adapted to grip an object or load which is not intended to be lifted.

The device 10 for gripping a barrel 12 comprises a first tube 14 having distal and proximate longitudinal ends 16 and 18 and a second tube 20, telescopically received in the first tube 14 and having proximate and distal longitudinal ends 22 and 24.

Figure 2:
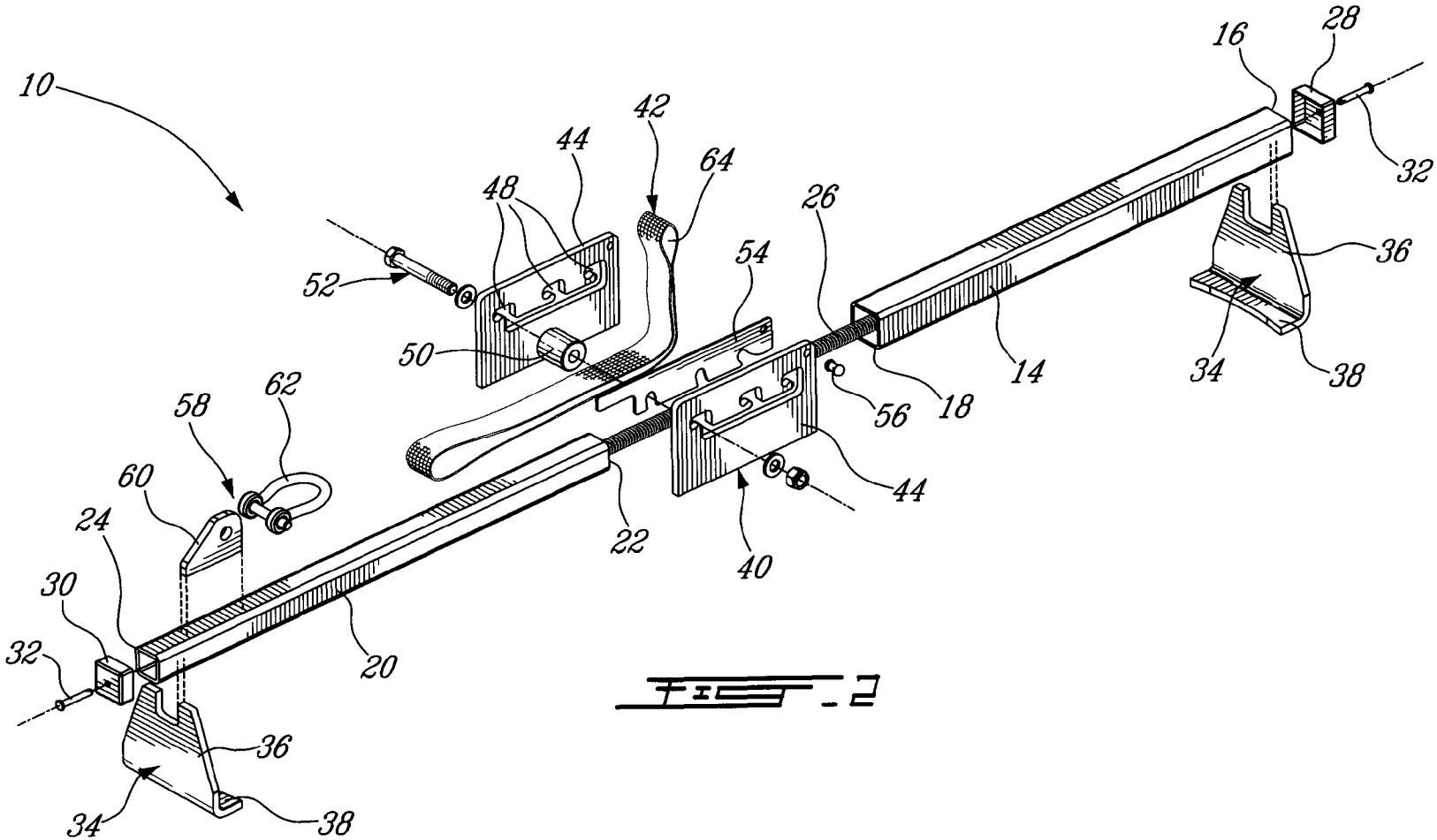
FIG. 2 is an exploded perspective view of the device for gripping a load structure of FIG. 1.
Figure 3:
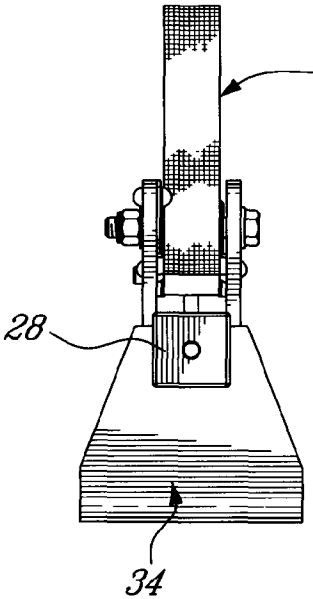
FIG. 3 is an end view of the device for gripping a load structure of FIG. 1.
Figure 4:
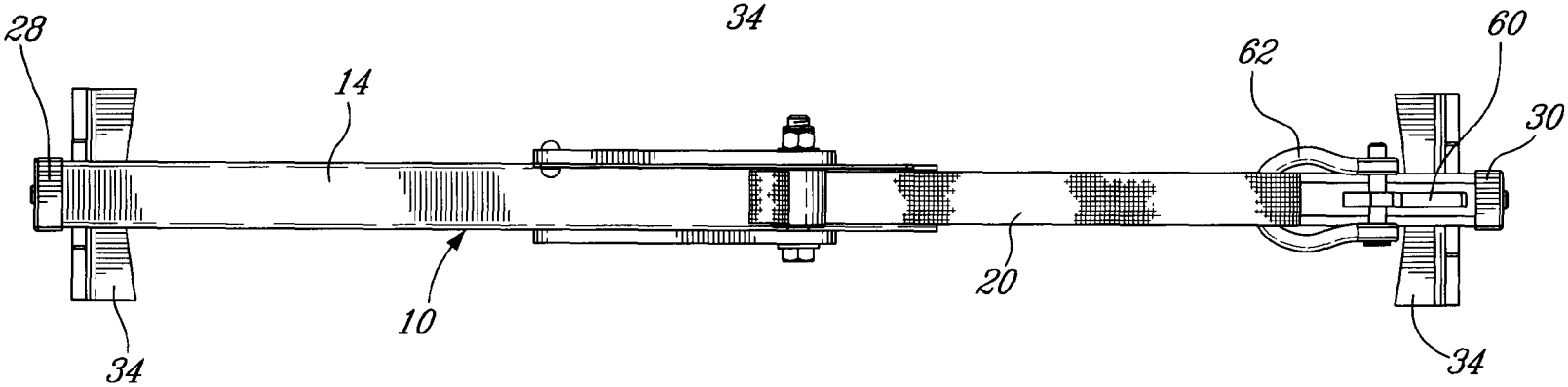
FIG. 4 is a top plan view of the device for gripping a load structure of FIG. 1.
Figure 5:
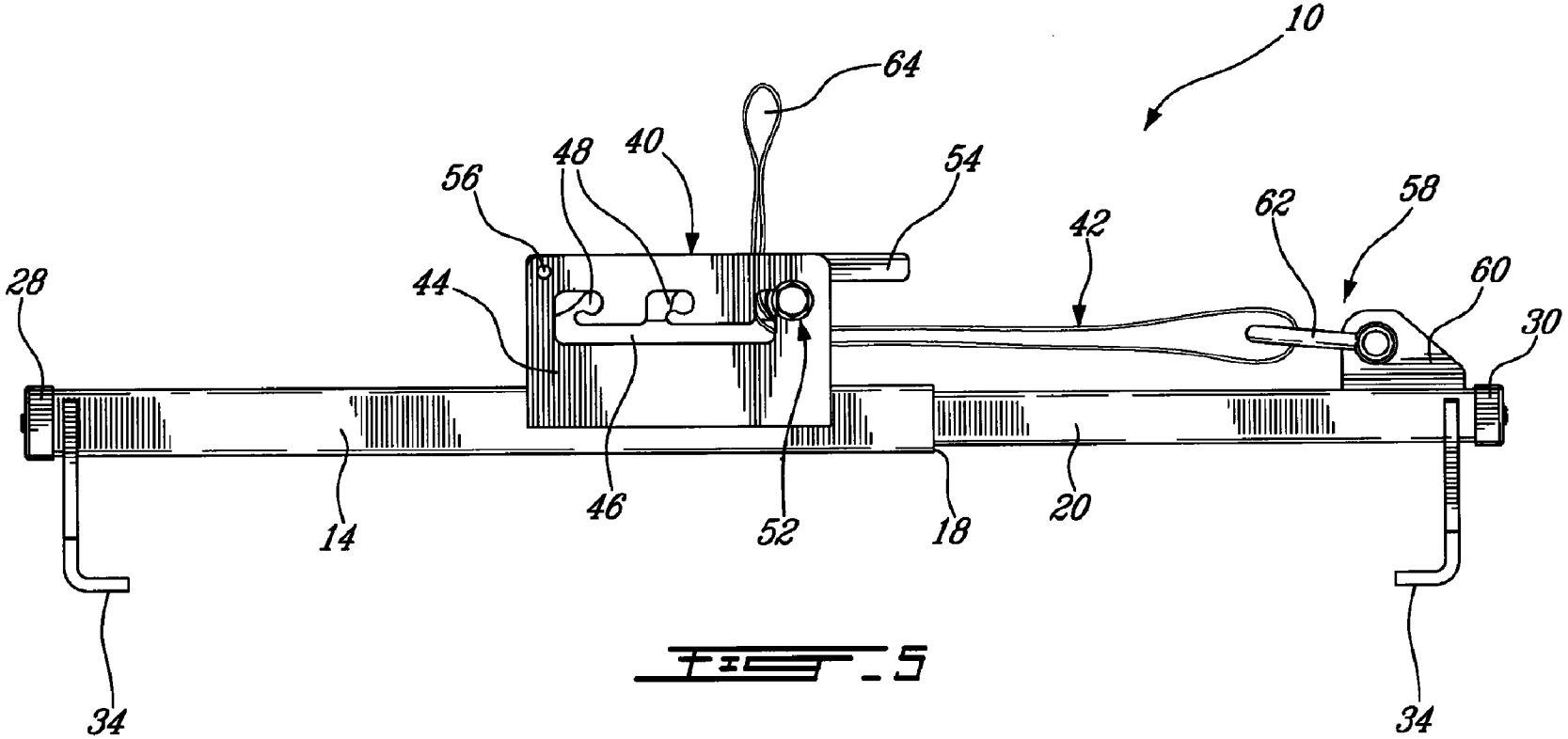
FIG. 5 is a side elevation view of the device for gripping a load structure of FIG. 1.

As can be better seen in FIG. 2, the device 12 further comprises a biasing member, in the form of a spring 26, mounted inside the tubes 14 and 20. The spring 26 is mounted to both the tubes 14 and 20 therebetween for pulling the distal end 28 of the first tube 14 and the distal end 30 of the second tube 20 towards one another. More specifically, the spring 26 is held inside the tubes 14 and 20 by the caps 28 and 30 and the fasteners 32. Other means can also be used to maintain the spring in place in the tubes 14 and 20.

The first and second tubes 14 and 20 are each provided with a gripper 34 respectively secured adjacent their distal ends 16 and 24, yielding a jaw having an variable distance between the grippers 34.

According to the first illustrated embodiment, the grippers 34 are in the form of rim contacting brackets which are so configured and sized as to conform to the shape of a typical barrel 12. More specifically, each rim contacting bracket 34 includes a first portion 36 secured to the tube 14 or 20 and extending generally perpendicularly therefrom, and a second portion 38 extending from the first portion 36 in a direction opposite the tube 14 or 20 generally perpendicularly therefrom, for contacting the barrel 12 below its rim 13. The second portion 38 of the rim contacting bracket 34 is arcuate to conform to the shape of the barrel 12. More specifically, the second portion of the rim contacting bracket is shaped so as to conform to barrels of different diameters.

The barrel gripping device 10 further comprises an adjustable fulcrum assembly 40, secured to the first tube 14 adjacent the proximate end 22 thereof, and a flexible element 42, mounted to the second tube 20 adjacent the distal end 24 thereof, and operatively coupled to the fulcrum assembly 40 so that an externally applied force on the flexible element 42 yields an inward force between the two grippers 34.

The adjustable fulcrum assembly 40 includes two identical flat brackets 44, each having a longitudinal slot 46 and three L-shaped slots 48 extending therefrom. The brackets 44 are fixedly mounted to opposite sides of the first tube 14.

A fulcrum element in the form of a rotatable cylinder 50 is maintained between the two flat brackets 44 by a fastener mechanism 52 which traverses the longitudinal slot 46. The cylinder 50 engages the two flat brackets 44 for free movement from one L-shaped slots 48 to another via the longitudinal slot 46.

A locking plate 54 is pivotably mounted to one of the flat brackets 44 via a pivot pin 56. When the locking plate 54 is in its unlocked position, the fastener mechanism 52 and associated rotatable cylinder 50 can be manually moved from one L-shaped slot 48 to another. Conversely, when the locking plate 54 is in its locked position, the fastener mechanism 52 and associated rotatable cylinder 50 cannot be moved from one L-shaped slot 48 to another.

The flexible element 42 is in the form of a strap which is mounted to the second tube 20 via a strap-securing assembly 58.

The strap-securing assembly 58 includes a pierced bracket 60 secured to the second tube 20. A shackle 62 is mounted to the pierced bracket 60.

The shackle 62 supports the strap 42 which engages the rotatable cylinder 50. The strap 42 defines a loop 64 that may be engaged by a lifting apparatus (not shown).

The strap 42 is configured and sized so as to withstand the weight of the barrel 12.

As will now become more apparent, the fastener assembly 52 and two flat brackets 44 with their three L-shaped slots 48 form an adjustment assembly allowing different diameter barrels (three according to the illustrative embodiment) to be lifted by the device 10. More specifically, the adjustment assembly allows centering the fulcrum element 50 relatively to the two grippers 34.

Indeed, even though the configuration of the device 10 may vary from a retracted position, where the bracket 60 abuts the proximate end 18 of the tube 14, to an extended position, where a maximum distance is reached between the two grippers 34, it has been found advantageous to center the cylinder 50 so that the load be balanced during its lifting. It is to be noted that the maximum distance that can be reached between the two grippers 34 is set by the rigidity of the spring 26.

The fulcrum assembly 40 is not limited to the illustrative embodiment. For example, the adjustment assembly can take any other form allowing to modify the position of the cylinder 50 or to any other member acting as a fulcrum for the flexible element 42 relatively to the distal end 24 of the second tube 20 where the flexible element 42 is secured.

The fulcrum member 50 allows transferring a pulling force applied to the flexible member 42 to an inward force between the two members 14 and 20.

According to a further illustrative embodiment (not shown), the fulcrum assembly is in the form of a removable ring, including or not a friction element, that can be mounted at any one of predetermined longitudinal positions along the first tube 14 and which allows receiving the strap 42 therein for operative cooperation. According to this specific embodiment, the tube includes holes or supports at the predetermined positions to receive a complementary mounting bracket secured to the removable ring for mounting thereto.

According to still a further illustrative embodiment of the present invention, the fulcrum assembly 40 includes a member acting as a fulcrum for the flexible element 42 that is fixedly mounted to the first tube 14 at a predetermined position.

According to a still further embodiment, the fulcrum member is slidably mounted to the first tube 14 so that the load automatically centers and balances itself when it is lifted.

As will now be explained in more detailed, the inward forces between the two grippers 34, which results from an external pulling forces being applied to the strap 42, is applied in addition to the biasing force caused by the spring 26, which is permanent.

In operation, the user first determines the position of the fastener 52 and rotatable cylinder 50 depending on the diameter of the barrel 12 to be lifted. Then the user manually spreads apart the two grippers 34 by overcoming the biasing action of the spring 26 and positions the grippers 34 about the rim 13 of the barrel 12 (see FIG. 1). Since the biasing action of the spring 26 forces the grippers 34 towards one another, the device 10 automatically grips onto the barrel 12. The device 10 is therefore operable by a single user, which then has its two hands free to secure the loop 64 of the strap 42 to a lifting apparatus (not shown).

Indeed, the lifting apparatus, usually provided with a hook or other similar attachment (not shown), may be engaged to the loop 64 of the strap 42. By pulling the loop 64 upwardly, the tubes 14 and 20 are forced toward one another since the flat brackets 44 are mounted to the tube 14 and one end of the strap 42 is secured to the distal end of the tube 20. Accordingly, the barrel 12 may be lifted since it is then firmly gripped by the device 10.

As will now become more apparent to a person skilled in the art, the configuration of the barrel gripping device 10 allows using the weight of the barrel 12 for its gripping. More specifically, the pulling force resulting from the weight of the barrel 12 (see arrow 74 on FIG. 1), as it is lifted for example by an overhead crane (see arrow 76), is transferred to the grippers 34 therebetween, resulting in a restraining force onto the barrel 12 (see arrow 78). The heavier is the load, the stronger is the restraining force.

Figure 6:
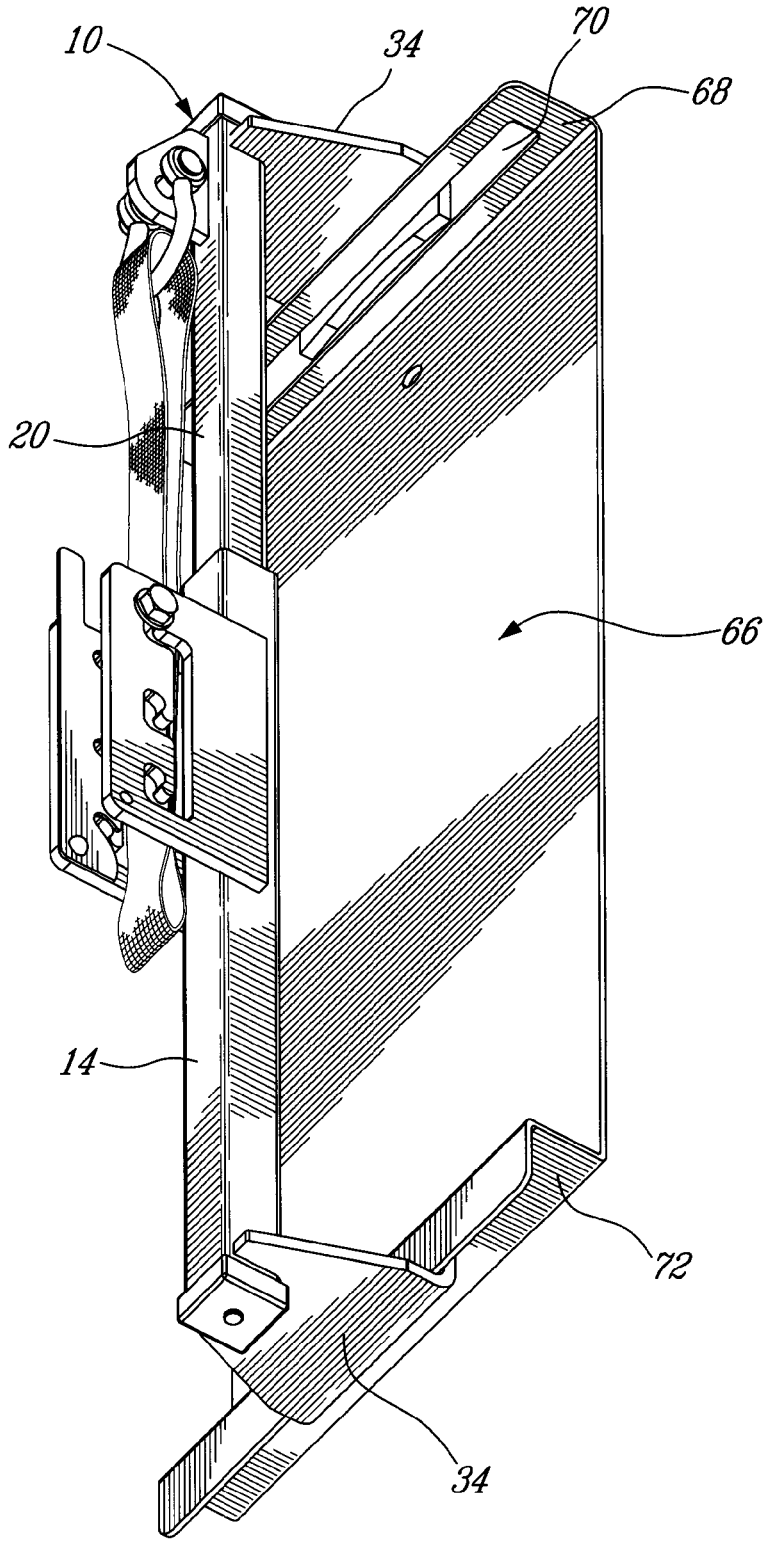
FIG. 6 is a perspective view of the device for gripping a load structure of FIG. 1; the device being shown mounted to a holder to mount the device to a surface such as a wall when not in use.
Figure 7:
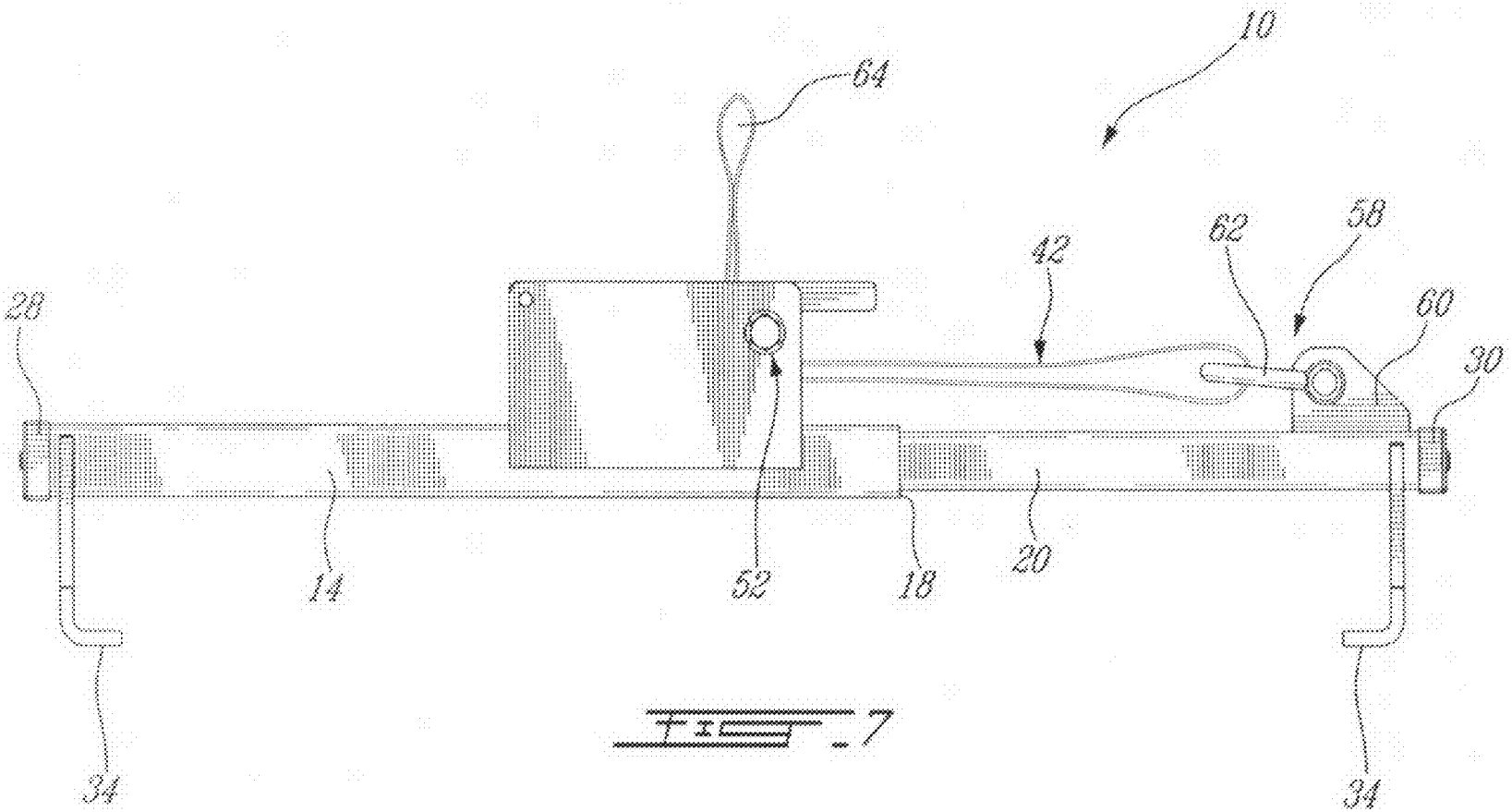
FIG. 7 is a side elevation view of a device for gripping a load structure according to a second illustrative embodiment.

When not in use, the device 10 may be vertically mounted to a wall via a mounting element 66 (see FIG. 6).

The mounting element 66 comprises a generally flat central portion for mounting to a wall (not shown) or to any other surface, for example using fasteners (not shown), a top flange 68 including an elongated opening 70 for receiving one of the two grippers 34 of the device 10 and a bottom L-shaped flange 72 for receiving the other gripper 34.

Similarly to the above-described mounting of the device 10 onto the rim 13 of a barrel 12, the device 10 can be firmly secured onto the mounting element 66 under the biasing action of the spring 26.

The top and bottom flanges 68 and 72 may have other configuration allowing to receive the grippers 34. They can for example be identical.

It is to be noted that the various elements of the device 10 are advantageously made of strong material such as without limitations steel. The strap 42 is advantageously made of strong fabric material such as polyester webbing sling. It is also to be noted that the brackets 44 and 60 and the grippers 34 are fixedly mounted to the tubes, for example via welding. They can also be integral.

It is to be noted that many modifications could be made to the device for gripping a load structure 10 described hereinabove, for example:

The biasing member mounted in the tubes can take another form, including without limitations a pneumatic, hydraulic or electric cylinder. It can also be omitted. In this last case, the biasing action of the two grippers 34 towards each other would not be present. In the case where a cylinder is included, the biasing member can further include a worm or other means to limit the inward force exerted onto between the two grippers by pulling on the flexible member. Conversely, a cylinder can be used to increase said inward force exerted onto the grippers.

Other members than tubing, elongated or not, can be used, equipped with grippers at their ends so as to define a jaw. A first of these other members can be slidably mounted to the second of these members using rollers, tracks or any other sliding elements (not shown). The first and second jaw members can be in the form of or include plates, frame, etc.

The device 10, and more specifically the length of the tubes 14 and 20, and the grippers 34 can be adapted to grip other object than a barrel 12.

The configuration, dimensions and/or materials of the grippers can be adapted for the load to grip. For example, the grippers can include electro-magnets, retractable portions, etc.

The flexible element 42 can be for example a strap, a cable or a chain and be provided with any fastening equipment for attaching the device to lifting equipment (not shown).

Even though the device 10 has been illustrated with reference to an application where a load is lifted, a device for gripping a load structure according to the present invention is not limited to such an application. For example, the present invention can be used to firmly grip a load while it is pulled horizontally. A device for gripping a load structure according to the present invention is also particularly suitable to squeeze an object or to bring together two objects or parts wherein a force is required for their bringing together.

It is to be understood that the invention is not limited in its application to the details of construction and parts illustrated in the accompanying drawings and described hereinabove. The invention is capable of other embodiments and of being practiced in various ways.

It is also to be understood that the phraseology or terminology used herein is for the purpose of description and not limitation. Hence, although the present invention has been described hereinabove by way of illustrative embodiments thereof, it can be modified, without departing from the spirit, scope and nature of the subject invention as defined in the appended claims.

What is claimed is:

1. A device for gripping a load structure comprising:

a first jaw member having a proximate end and a distal end; the distal end of the first jaw member being provided with a first gripper;

a second jaw member having a proximate end and a distal end; the distal end of the second jaw member being provided with a second gripper; the second jaw member being slidably mounted to the first jaw member so as to define a jaw therewith having a variable distance between the first and second grippers;

a fulcrum member mounted to the first jaw member near the proximate end thereof; the fulcrum member being slidably mounted to the first jaw member via a fulcrum assembly that allows to modify the position of the fulcrum member relatively to the distal end of the second jaw member; and a flexible element secured to the second jaw member near the distal end thereof operatively coupled to the fulcrum member for causing an externally applied pulling force on the flexible element to move the distal end of the first jaw member towards the distal end of the second jaw member so as to yield a first inward force between the first and second grippers.

2. A device as recited in claim 1, further comprising a biasing member mounted to both the first and second jaw members for pulling the distal end of the first jaw member and the distal end of the second jaw member towards one another, causing a permanent second inward force between the first and second grippers.

3. A device as recited in claim 1, wherein the load structure is suspended by the flexible element; the externally applied force being the weight of the load.

4. A device as recited in claim 3, wherein the load is a barrel.

5. A device as recited in claim 4, wherein the barrel is provided with a top rim; the first and second grippers being in the form of rim contacting brackets.

6. A device as recited in claim 1, wherein the first and second jaw members are first and second tubes; the second tube being telescopically received in the first tube.

7. A device as recited in claim 6, further comprising a biasing member mounted to the first and second tubes inside thereof for pulling the distal end of the first tube and the distal end of the second tube towards one another, causing a permanent second inward force between the first and second grippers.

8. A device as recited in claim 1, wherein the second jaw member is slidably mounted to the first jaw member via at least one sliding element.

9. A device as recited in claim 1, wherein the flexible element is selected from the group consisting of a strap, a cable and a chain.

10. A device for gripping a load structure comprising:

a first jaw member having a proximate end and a distal end; the distal end of the first jaw member being provided with a first gripper;

a second jaw member having a proximate end and a distal end; the distal end of the second jaw member being provided with a second gripper; the second jaw member being slidably mounted to the first jaw member so as to define a jaw therewith having a variable distance between the first and second grippers;

a fulcrum member mounted to the first jaw member near the proximate end thereof; the fulcrum member being mounted to the first jaw member via a fulcrum assembly that allows to modify the position of the fulcrum member relatively to the distal end of the second jaw member; the fulcrum assembly including a fastener mechanism for selectively securing the fulcrum member at any one of a plurality of positions on the first jaw member relatively to the distal end of the second jaw member; and a flexible element secured to the second jaw member near the distal end thereof operatively coupled to the fulcrum member for causing an externally applied pulling force on the flexible element to move the distal end of the first jaw member towards the distal end of the second jaw member so as to yield a first inward force between the first and second grippers.

11. A device as recited in claim 10, wherein the fulcrum assembly includes two identical flat brackets fixedly mounted on opposite sides of the first jaw member; each of the two flat brackets including a longitudinal slot and a plurality of L-shaped slots extending from the longitudinal slot; each of the plurality of L-shaped slots corresponding to the plurality of positions along the second jaw member; the fulcrum member being mounted to the two flat brackets therebetween for free movement from one L-shaped slots to another via the longitudinal slots; the fulcrum assembly further comprising a locking element pivotably mounted to at least one of the two flat brackets for selectively engaging the fulcrum member while it is inserted in one of the plurality of L-shaped slots.

12. A device for gripping a load structure comprising:

a first tube having a proximate end and a distal end; the distal end of the first tube being provided with a first gripper;

a second tube having a proximate end and a distal end; the distal end of the second tube being provided with a second gripper; the second tube being telescopically received in the first tube so as to define a jaw therewith having a variable distance between the first and second grippers;

a fulcrum member mounted to the first jaw member near the proximate end thereof;

a flexible element secured to the second tube near the distal end thereof operatively coupled to the fulcrum member for causing an externally applied pulling force on the flexible element to move the distal end of the first tube towards the distal end of the second tube so as to yield a first inward force between the first and second grippers; and a biasing member mounted to the first and second tubes inside thereof for pulling the distal end of the first tube and the distal end of the second tube towards one another, causing a permanent second inward force between the first and second grippers; wherein the load structure is a barrel provided with a top rim; the first and second grippers being in the form of rim contacting brackets; the device further comprising a detachable mounting element for mounting the device to a surface for storage; the mounting element comprising a central portion for securing the mounting element to a supporting structure, and top and bottom flanges for receiving the first and second grippers.

* * * * *